US009605431B2

(12) United States Patent
Thornton et al.

(10) Patent No.: US 9,605,431 B2
(45) **Date of Patent: *Mar. 28, 2017**

(54) TIMBER STRUCTURAL MEMBER WITH EMBEDDED WEB

(71) Applicant: LOGGO IP PTY LTD, Oak Flats (AU)

(72) Inventors: Patrick Thornton, Oak Flats (AU); Peter Blair, Willoughby (AU)

(73) Assignee: LOGGO IP PTY LTD, Oak Flats (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/563,573

(22) Filed: Dec. 8, 2014

(65) Prior Publication Data

US 2015/0089900 A1 Apr. 2, 2015

Related U.S. Application Data

(63) Continuation-in-part of application No. 12/845,251, filed on Jul. 28, 2010, now Pat. No. 8,910,454, which
(Continued)

(30) Foreign Application Priority Data

Feb. 1, 2008 (AU) ..... 2008900435
Apr. 9, 2008 (AU) ..... 2008901730

(51) Int. Cl.
*E04C 3/17* (2006.01)
*E04C 3/14* (2006.01)
(Continued)

(52) U.S. Cl.
CPC ..... *E04C 3/17* (2013.01); *E04B 1/26* (2013.01); *E04C 3/14* (2013.01); *E04C 3/18* (2013.01);
(Continued)

(58) Field of Classification Search
CPC ..... E04B 1/10; E04B 1/18; E04B 1/26; E04B 1/2604; E04B 1/02; E04B 1/70;
(Continued)

(56) References Cited

U.S. PATENT DOCUMENTS 1,813,455 A * 7/1931 Lawton ..... 52/233
2,130,231 A * 9/1938 Forciea ..... 52/233
(Continued)

FOREIGN PATENT DOCUMENTS

AU 144245 S 6/2001
AU 144458 S 7/2001
(Continued)

OTHER PUBLICATIONS

Epoxy Grouted Steel Rods [retrieved Nov. 20, 2009]. Retrieved from Internet: URL: http://www.nzwood.co.nz/how-wood/structural-connections/epoxy-grouted-steel-rods.
(Continued)

*Primary Examiner* — Joshua J Michener
*Assistant Examiner* — Theodore Adamos
(74) *Attorney, Agent, or Firm* — David D. Brush; Westman Champlin & Koehler, P.A.

(57) ABSTRACT

A timber joist is provided, which includes first and second flanges connected together by a web, the web being structurally integral with the flanges. Both flanges comprise timber poles. The web inserts into the first and second flanges a sufficient distance so as to provide resistance to longitudinal splitting or cracking of the timber.

16 Claims, 4 Drawing Sheets

Related U.S. Application Data is a continuation-in-part of application No. PCT/AU2009/000082, filed on Jan. 28, 2009.

(51) Int. Cl.

| | |
|---|---|
| ***E04C 3/29*** | (2006.01) |
| ***E04C 3/18*** | (2006.01) |
| ***E04C 3/292*** | (2006.01) |
| ***E04C 3/42*** | (2006.01) |
| ***E04B 1/26*** | (2006.01) |
| *E04B 1/10* | (2006.01) |

(52) U.S. Cl.

CPC ..... *E04C 3/29* (2013.01); *E04C 3/292* (2013.01); *E04C 3/42* (2013.01); *E04B 1/10* (2013.01); *E04B 2001/2648* (2013.01); *E04B 2001/2668* (2013.01)

(58) Field of Classification Search

CPC ..... E04B 2/702; E04B 2/703; E04B 2/708; E04B 2001/264; E04B 2001/2676; E04B 2001/2692; E04B 2001/2648; E04B 2001/2668; E04C 3/02; E04C 3/12; E04C 3/14; E04C 3/17; E04C 3/29; E04C 3/18; E04C 3/292; E04C 3/42

USPC ..... 52/233, 220.7, 523, 560, 578, 588.1, 52/589.1, 854, 633, 636, 838, 837

See application file for complete search history.

(56) References Cited

U.S. PATENT DOCUMENTS

| | | | | | |
|---|---|---|---|---|---|
| 2,416,162 | A | * | 2/1947 | Drake | 52/233 |
| 2,463,612 | A | * | 3/1949 | Grudda | 52/233 |
| 2,619,686 | A | * | 12/1952 | Dombrowski | 52/233 |
| 3,460,301 | A | * | 8/1969 | Davis | 52/233 |
| 3,527,005 | A | * | 9/1970 | Slavens | 52/223.7 |
| 3,802,206 | A | | 4/1974 | Moore et al. | |
| 4,012,876 | A | * | 3/1977 | Grubbs | 52/233 |
| 4,249,355 | A | * | 2/1981 | Anderson et al. | 52/590.1 |
| 4,305,238 | A | * | 12/1981 | Harward et al. | 52/233 |
| 4,356,676 | A | * | 11/1982 | Hauptman | 52/396.04 |
| 4,413,459 | A | * | 11/1983 | Lambuth | 52/837 |
| 4,429,500 | A | * | 2/1984 | Farmont | 52/233 |
| 4,443,990 | A | * | 4/1984 | Johnson | 52/514 |
| 4,463,532 | A | | 8/1984 | Faw | |
| 4,677,806 | A | * | 7/1987 | Tuomi | 52/656.1 |
| 5,058,343 | A | | 10/1991 | Nipko | |
| 5,277,008 | A | * | 1/1994 | Saulez | 52/233 |
| 5,362,545 | A | | 11/1994 | Tingley | |
| 5,456,781 | A | | 10/1995 | Tingley | |
| 5,466,086 | A | * | 11/1995 | Goto | 403/268 |
| 5,498,460 | A | | 3/1996 | Tingley | |
| 5,505,028 | A | * | 4/1996 | Giles | 52/233 |
| 5,547,729 | A | | 8/1996 | Tingley | |
| 5,565,257 | A | | 10/1996 | Tingley | |
| 5,618,371 | A | * | 4/1997 | Sing | 156/264 |
| 5,641,553 | A | | 6/1997 | Tingley | |
| 5,648,138 | A | | 7/1997 | Tingley | |
| 5,721,036 | A | | 2/1998 | Tingley | |
| 5,736,220 | A | | 4/1998 | Tingley | |
| 5,885,685 | A | | 3/1999 | Tingley | |
| 5,910,352 | A | | 6/1999 | Tingley | |
| 5,974,760 | A | | 11/1999 | Tingley | |
| 6,051,301 | A | | 4/2000 | Tingley | |
| 6,120,207 | A | * | 9/2000 | Goto | 403/268 |
| 6,173,550 | B1 | | 1/2001 | Tingley | |
| 6,199,332 | B1 | * | 3/2001 | Ellson | 52/233 |
| D459,488 | S | | 6/2002 | Thornton et al. | |
| D459,493 | S | | 6/2002 | Thornton et al. | |
| D462,788 | S | * | 9/2002 | Thornton et al. | D25/121 |
| D462,798 | S | | 9/2002 | Sakae | |
| D475,144 | S | | 5/2003 | Thornton et al. | |
| 8,561,373 | B1 | * | 10/2013 | McDonald | 52/846 |
| 2007/0204538 | A1 | * | 9/2007 | Miller et al. | 52/233 |
| 2009/0293373 | A1 | * | 12/2009 | Klinkhamer et al. | 52/79.9 |
| 2011/0016824 | A1 | | 1/2011 | Thornton et al. | |

FOREIGN PATENT DOCUMENTS

| | | | |
|---|---|---|---|
| AU | 150489 | S | 1/2003 |
| AU | 156224 | S | 8/2004 |
| AU | 158523 | S | 3/2006 |
| EP | 0034224 | A2 | 8/1981 |
| FR | 2556030 | A1 | 6/1985 |

OTHER PUBLICATIONS

Office Action dated Jan. 18, 2012 for Corresponding U.S. Appl. No. 12/845,251, filed Jul. 28, 2010.

Final Office Action dated Jun. 13, 2012 for Corresponding U.S. Appl. No. 12/845,251, filed Jul. 28, 2010.

Office Action dated Aug. 30, 2013 for Corresponding U.S. Appl. No. 12/845,251, filed Jul. 28, 2010.

Final Office Action dated Apr. 7, 2014 for Corresponding U.S. Appl. No. 12/845,251, filed Jul. 28, 2010.

Notice of Allowance and Fee(s) Due dated Aug. 28, 2014 for Corresponding U.S. Appl. No. 12/845,251, filed Jul. 28, 2010.

* cited by examiner

TIMBER STRUCTURAL MEMBER WITH EMBEDDED WEB

RELATED APPLICATIONS

This application is a continuation-in-part of U.S. patent application Ser. No. 12/845,251 filed on Jul. 28, 2010, and which was published on Jan. 27, 2011 as published United States Patent Application Publication 2011/0016824 A1 which is herein incorporated by reference, U.S. patent application Ser. No. 12/845,251 being a continuation-in-part of international application PCT/AU2009/000082, which designated the United States of America and was filed on Jan. 28, 2009, and which was published on Aug. 6, 2009 as published PCT application WO 2009/094696 A1, which is herein incorporated by reference.

FIELD OF THE INVENTION

The invention generally relates to the field of structural members for use in building construction. More particularly, but not exclusively, the invention relates to timber structural members for portal frames, which can be incorporated into modular building systems.

BACKGROUND OF THE INVENTION

Timber structural members play an important part in the construction of building structures. Timber is commonly used for joists, beams, columns, rafters and frames because of its strengths for load bearing and its natural ability to withstand a variety of forces. Additionally, compared to metal based materials, timber structural members often cost less to manufacture and are more easily cut and processed for specific building requirements. A strong and useful type of structural member is an "I-joist". The I-joist comprises two flange members with an interconnecting web member, resembling a letter "I" in its cross-section. I-joists have good load bearing and distribution capabilities and are key components in building construction.

The flanges of timber I-joists (hereon called "timber joists") have historically been made from solid wood lumber or laminated timber. In order to obtain flanges of appropriate length and cross-sectional dimensions, relatively large diameter lumber is required. Any imperfection in the flange can greatly compromise the strength of the flange, so relatively high quality lumber is required for the manufacture of timber joists. This has led in turn to increased cost in production as well as raising natural resource conservation issues. Depending on the part of the log it is sawn from, the solid lumber may have issues with natural defects such as splinters, rot, abnormal growth and grain structures. Additionally, when sawn and prepared for commercial use the lumbers are prone to processing defects such as chipping, torn grain and timber wanes.

To address the problems associated with solid wood lumber, alternative forms of wood material for making timber joists have been sought. These include engineered wood composites such as plywood, laminated veneer lumber ("LVL"), oriented strand lumber ("OSL") and oriented strand board ("OSB"). Wood composites have the advantage of being less expensive in raw material cost (as they are able to be formed from lower grade wood or even wood wastes) and do not have the problems associated with solid lumber defects. However, the energy and resource requirements in their manufacture are generally significantly higher as processed structural timber requires significantly more cutting, bonding, and curing than naturally formed timber. Also, timber joists made from wood composites do not have effective end grain connection and when used in building construction they are usually joined by bearing onto another member and nailed to deter sideway twisting and/or movement. This type of connection often requires further mounted metal braces which become design hindrances. Additionally, the metal braces are prone to oxidation and collapse in fire as the metal heats more readily than the timber, resulting in charring of the adjoining timber and loss of support.

United States Patent Application Publication 2011/0016824 describes a timber joist comprising first and second flanges connected together by a web, the web being structurally integral with the flanges. Both flanges comprise timber poles. While this joist is useful, it has been found that under high loads longitudinal splits or cracks may form in the timber. The splits or cracks are found to occur in regions of the timber about the web, and can lead to catastrophic failure of the joist under high load conditions.

It is an aspect of the present invention to provide a timber structural member that has an improved resistance to splitting or cracking for a given load. It is another aspect to provide an alternative to a timber structural member of the prior art.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

In a first aspect, but not necessarily the broadest aspect the present invention provides a timber joist comprising first and second flanges connected together by a web which is structurally integral with the flanges, both flanges comprising timber poles, wherein each flange has a slot formed therein which extends longitudinally along the length of the flange, the slot being dimensioned to receive the web, the web being bonded in the slot, and wherein the web extends to a depth of at least about 20% of the diameter of the flange into which it is embedded.

It has been surprisingly found that the propensity of the timber to crack or split under load is improved as compared with a timber joist disclosed in United States Patent Application Publication 2011/0016824 A1. This improvement is the result of the web extending further into the flange in which it is embedded than for any joist disclosed in United States Patent Application Publication 2011/0016824 A1.

Thus, for a given load a timber joist of the present invention has a lower propensity for cracking or splitting as compared with any joist disclosed in United States Patent Application Publication 2011/0016824 A1. It has been found that increased resistance to splitting or cracking In one embodiment of the timber joist, the web extends to a depth of at least about 21%, 22%, 23%, 24%, 25%, 26%, 27%, 28%, 29% or 30% the diameter of the flange into which it is embedded.

In another embodiment of the timber joist, the web extends to a depth of at least about 31%, 32%, 33%, 34%, 35%, 36%, 37%, 38%, 39%, 40%, 41%, 42%, 43%, 44%, 45%, 46%, 47%, 48%, 49%, 50%, 55%, 60%, 65%, 70%, 75%, 80%, 85%, 90% or 95% the diameter of the pole into which it is embedded. In one embodiment, the web extends along a radial line and to the axial centre of the flange.

In one embodiment of the timber joist, the web completely bisects the flange into which it is embedded. In that embodiment, the slot has been further modified to completely remove the slot floor thereby bisecting the flange.

In one embodiment of the timber joist, the web extends to a depth and/or along a line so as to not interfere with an attaching means or a reinforcing means in the flange into which the web is embedded. In some embodiments, the web has an aperture or discontinuity which allows for a bore or other feature to pass through it. Accordingly, the web can extend beyond the level of any bore or other feature, and therefore more deeply into the timber.

In one embodiment of the timber joist, the web extends substantially along a radius of the member into which it is embedded.

In one embodiment of the timber joist, the web is generally planar.

In one embodiment of the timber joist, the web extends the full length of the flanges.

In one embodiment of the timber joist, the web extends beyond the length of the flanges.

In one embodiment of the timber joist, the web is shorter than the length of the flanges.

In one embodiment of the timber joist, the web comprises one or more segments and the flanges include one or more slots, and wherein each web segment connects into one of the corresponding slots in the flanges.

In one embodiment of the timber joist, the web is formed of a relatively high strength planar material.

In one embodiment of the timber joist, the web is formed of a material selected from a group including: timber, processed timber; chipboard, plywood, metal sheet, metal plate, fibre reinforced cement sheet, plastic, and fibre reinforced plastic material.

In one embodiment of the timber joist, flanges are parallel to each other and the web is of elongate rectangular shape.

In one embodiment of the timber joist, one or more ends of the flanges are configured to form a dowel connection.

In one embodiment of the timber joist, the dowel connection is comprised of an axial bore in the flange sized to receive a dowel.

In one embodiment of the timber joist, the dowel connection comprises a mild steel or high strength steel rod.

In one embodiment of the timber joist, one or more ends of the flanges is provided with a radial cut shaped and positioned to engage with a further timber pole.

In one embodiment of the timber joist, one of more of the ends of the flanges is a configured so as to not be involved in a connection, and is instead configured to be a load bearing end.

In another aspect the present invention provides a structure comprising a plurality of interconnected structural members, wherein one or more of the structural members is a timber joist as described herein.

A further aspect of the present invention provides a truss comprising at least two timber poles in non-parallel alignment with each other, each pole having a slot therein, and a web bonded into the slots of the two poles to form a structurally integral assembly, and wherein the web extends to a depth of at least about 20% of the diameter of the pole into which it is embedded.

In one embodiment of the truss, the web extends to a depth of at least about 21%, 22%, 23%, 24%, 25%, 26%, 27%, 28%, 29% or 30% the diameter of the pole into which it is embedded.

In another embodiment of the truss, the web extends to a depth of at least about 31%, 32%, 33%, 34%, 35%, 36%, 37%, 38%, 39%, 40%, 41%, 42%, 43%, 44%, 45%, 46%, 47%, 48%, 49%, 50%, 55%, 60%, 65%, 70%, 75%, 80%, 85%, 90% or 95% the diameter of the pole into which it is embedded. In one embodiment, the web extends along a radial line and to the axial centre of the pole.

In one embodiment of the truss, the web completely bisects the flange into which it is embedded.

In one embodiment of the truss, the web extends to a depth and/or along a line so as to not interfere with an attaching means or a reinforcing means in the flange into which the web is embedded. In some embodiments, the web has an aperture or discontinuity which allows for a bore or other feature to pass through it.

In one embodiment of the truss, the web extends substantially along a radius of the member into which it is embedded.

In one embodiment of the truss, the web is generally planar.

In one embodiment of the truss, the web extends the full length of the poles.

In one embodiment of the truss, the web extends beyond the length of the poles.

In one embodiment of the truss, the web is shorter than the length of the poles.

In one embodiment of the truss, the web comprises one or more segments and the poles include one or more slots, and wherein each web segment connects into one of the corresponding slots in the flanges.

In one embodiment of the truss, the web is formed of a relatively high strength planar material.

In one embodiment of the truss, the web is formed of a material selected from a group including: timber, processed timber; chipboard, plywood, metal sheet, metal plate, fibre reinforced cement sheet, plastic, and fibre reinforced plastic material.

In one embodiment of the truss, the poles are parallel to each other and the web is of elongate rectangular shape.

In one embodiment of the truss, one or more ends of the poles are configured to form a dowel connection.

In one embodiment of the truss, the dowel connection is comprised of an axial bore in the flange sized to receive a dowel.

In one embodiment of the truss, the dowel connection comprises a mild steel or high strength steel rod.

In one embodiment of the truss, one or more ends of the flanges is provided with a radial cut shaped and positioned to engage with a further timber pole.

A flange or pole may have a slot formed therein which extends longitudinally along the length of the flange, the slot being dimensional to receive the web, the web being bonded in the slot.

The web may be formed of any suitable relatively high tensile strength planar material. Suitable materials include: processed timber such as chipboard, plywood or the like; metal sheet or plate; fibre reinforced cement sheet; plastics or fibre reinforced plastics materials; and the like. The flanges are preferably parallel to each other and the web is preferably of elongate rectangular shape.

The term "pole" as used herein is intended to mean a naturally occurring round cross-section pole having a central core and having had its peripheral surface trimmed so that the pole has a substantially constant cross-sectional shape along its full length. Suitable poles include true round plantation pine, such as slashpine or carribaea hybrids, or other timber species.

BRIEF DESCRIPTION OF THE DRAWINGS

FIG. 7 shows a front view of a section of a structural member for which the timber joist shown in FIG. 4 may connect to;

DETAILED DESCRIPTION OF THE EMBODIMENTS

Figure 1:
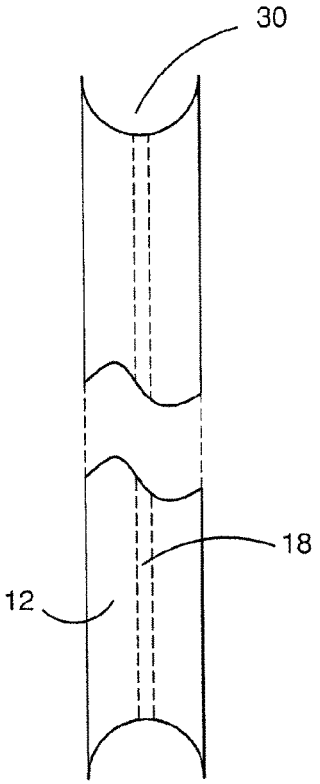
FIG. 1 shows a top view of a timber joist
Figure 2A:
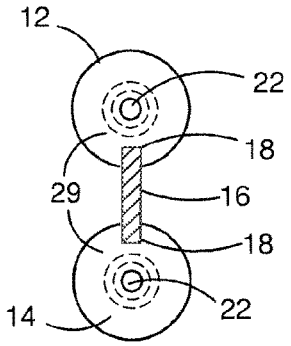
Figure 2a (prior art)
FIG. 2A shows an end view of a prior art timber joist.
Figure 2B:
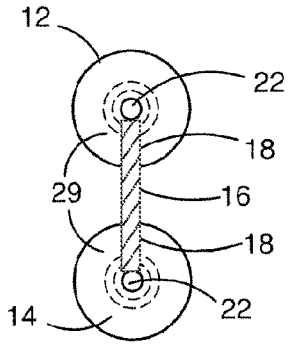
FIG. 2*b* shows an end view of the timber joist shown in FIG. 1.
Figure 3:
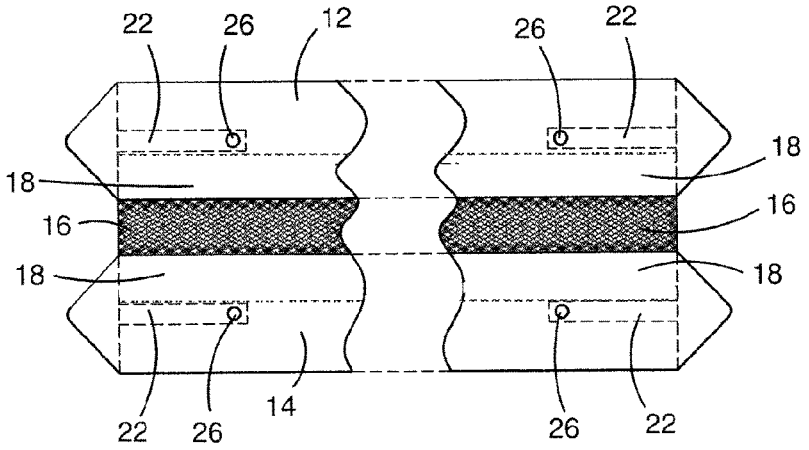
FIG. 3 shows a side view of the timber joist shown in FIG. 1.
Figure 4:
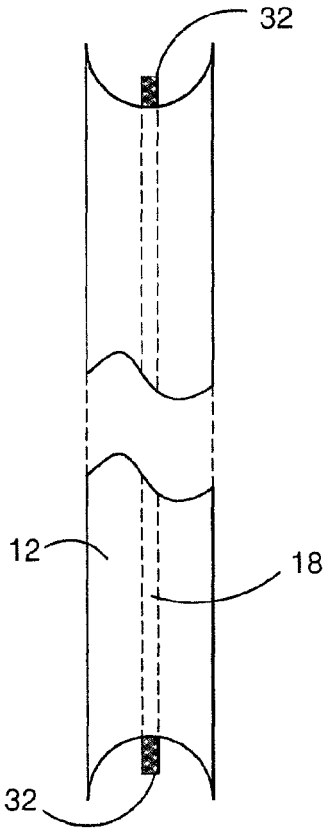
FIG. 4 shows a top view of an alternative embodiment of a timber joist
Figure 5:
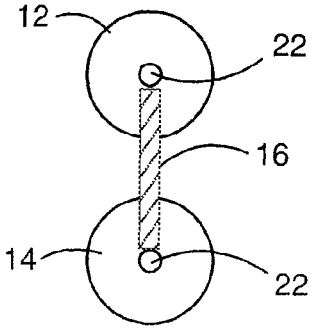
FIG. 5 shows a front view of the timber joist shown in FIG. 4.
Figure 6:
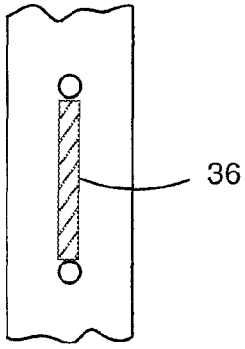
FIG. 6 shows an end view of the timber joist shown in FIG. 4.
Figure 7:
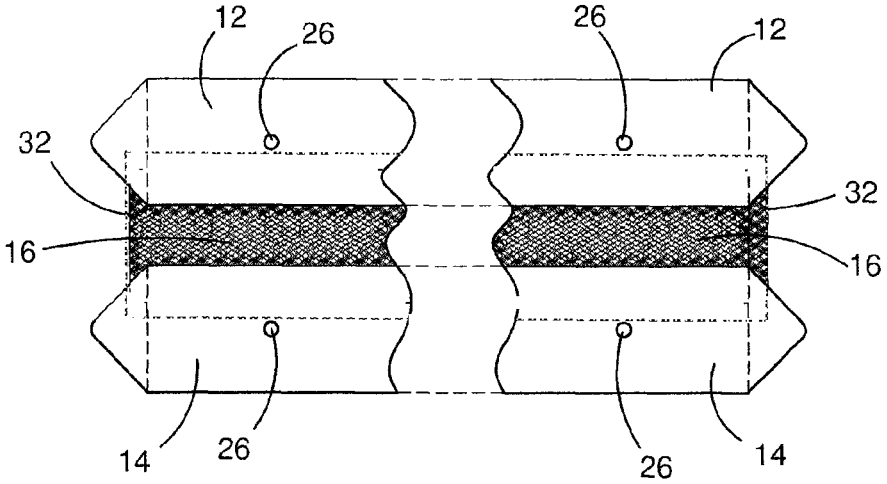

Referring initially to FIGS. 1, 2*b* and 3, a timber joist 10 in accordance with an embodiment of the invention is shown. FIG. 2*a* which is a prior art joist showing the relatively shallow embedment of the web 16.

The joist 10 comprises a first flange 12 and a second flange 14 which are joined together by a web 16 such that the two flanges 12 and 14 are aligned and parallel with each other and are spaced apart from each other by a predetermined distance. The diameter of the flanges 12 and 14 and the dimensions of the web 16 are selected so that the structural strength of the combined joist will meet predetermined design and load bearing requirements. The flanges 12 and 14 are comprised of timber poles.

As is shown, each of the flanges 12 and 14 has a rectangular groove or slot 18 cut therein into which the web 16 is located in a relatively close sliding fit. A suitable bonding material or other fixing means is used to secure the web 16 into the slots 18 to thereby ensure that the joist acts in a structurally integral manner. The bonding material that is used to bond the web 16 into the slots 18 will depend on the material from which the web 16 is formed. Typically a resin based waterproof structural adhesive will be appropriate.

In the embodiment of FIGS. 1, 2*b* and 3 the web 16 is embedded as far as possible, but not so far as to interfere with the bores 22.

In the preferred form of the invention, the web 16 is formed of a plywood or plywood like material which is well known in the art, and the bonding material selected will be of a type such that a high strength timber to timber bond is achieved between the web 16 and the timber from which the flanges 12 and 14 are made. If necessary, the composite joist may be treated after assembly to ensure that the web to flange bond is of high strength.

As mentioned, the flanges 12 and 14 are both formed of timber poles. Timber poles are selected because of the significant advantages that timber poles provide. A number of advantages which are inherent in the use of timber poles and are not to be found with other timber products such as sawn timber or laminated timber products. One significant advantage, for example, is that timber poles are relatively inexpensive and are manufactured simply by cutting down a suitable diameter tree and then trimming the outer surface of the tree to form a pole with a constant diameter along its full length. Only waste material such as bark and branches are cut from the outer surface of the pole.

Timber poles, sometimes called "logs" or "true rounds" are particularly strong since the natural strength of the timber fibres is not disrupted by sawing or other treatment. The integrity of the pole is maintained, and the trimming process required to circularise the pole will not greatly affect the overall strength of the pole. Also, it will be appreciated that the core of the pole, which is relatively structurally weak, is kept at the centre of the pole where, under load conditions, the stresses on the pole will be less than the stresses at the periphery of the pole.

It will be appreciated that the natural characteristics of timber are that the central core or pith of the pole is relatively soft and has low structural strength. The periphery of the pole, on the other hand, is much harder and the timber fibres are able to carry a high load. Also, this strong outer layer is more resistant to water absorption and thus by keeping the outer circumference of the timber pole intact, the structural integrity of the pole is maintained.

In addition to the benefits gained by use of timber poles, the joist (once assembled) acts as a composite member which serves to provides further structural strength and stability.

Thus, forming a structural member out of timber poles has a number of advantages, including relatively low waste, and maintaining the structural integrity of the round timber pole.

The overall height of the joist can be controlled by ensuring that timber poles of constant diameter are used, and that the slots 18 cut in the poles are of constant depth to accommodate standard dimension webs. Alternatively, if the diameters of the poles are variable to some degree, that variation can be accommodated by changing the depth of the slots 18 to ensure that the overall height dimension of the joist is constant. This will ensure that where the joists are used, for example, as supports for a deck or floor, the deck or floor is planar and all components of the deck or floor are supported by adjacent joists.

An alternative option is to cut a flat face, as indicated by dotted lines 20 into the top and bottom of the joist, with the faces 20 being a preselected distance apart from each other. This will ensure the joist has a flat bearing face on which cross members can be seated, and also ensures that the overall height of the joist can be precisely controlled.

Connection of the joist to any desired structure can conveniently be achieved by providing a pair of dowel type connections at each end of the joist. As shown in FIGS. 1, 2*b* and 3, each of the flanges 12 and 14 have had an axially central bore 22 machined into the end thereof to a predetermined depth. This bore 22 is dimensioned to receive a steel dowel (not shown). As will be appreciated, the axial bore 22 not only provides for a strong attachment means (as described below), it also removes the central weakest part of the pole flanges 12 and 14 thereby providing enhanced strength/structural integrity to the joist as a whole.

A lateral access bore 26 connects the end of the bore 22 to a location exterior of the pole and this lateral access bore 26 is used to inject a suitable adhesive bonding material into the bore 22 in order to bond the dowel into the bore 22.

In the embodiment of FIGS. 4 to 7 the web 16 is embedded as far as possible, but not so far as to interfere with the access bores 26.

Generally the bore 22 will be of slightly larger diameter than the dowel so that the bonding material injected through the access bore 26 will fully surround the dowel, thereby ensuring a high strength bonded connection between the dowel and the flange 12 or 14. A dowel centring ring (not shown), may be placed at the opening of bore 22 for axially centring the dowel. In this configuration the dowel is received through the ring into the bore 22 and the inner diameter of the centring ring matches substantially to the diameter of the dowel to enable a secure fit. The dowel centring ring may be made from plastic, metal or composite materials, or the like. The centring ring may comprise of lugs on the external diameter for secure placement of the ring to the opening of bore 22. The centring ring may be used to create a sealing face between the end 28 of the pole, and the pole or other structural component to which the joist is mounted, thereby ensuring a sealed continuous passage for bonding material injected into access bore 26.

The adhesive bonding material may comprise a two component epoxy material or in some applications a single phase resin may be used. Generally the adhesive will completely encase the dowel, thereby providing a barrier to corrosion of the dowel along its entire length.

By axially securing each of the flanges 12 and 14 of the joist all load forces experienced by the joist are transmitted axially through the flanges 12 and 14. This again serves to add to the strength of the connection and any construction erected using the joist.

Further, by housing the dowel inside the flange 12 or 14 the dowel is protected from fire. Other known joining systems make use of connectors (e.g. pins, nails, bolts, plates etc) which are externally fitted. In the event of a fire, such externally fitted connectors have been found to transfer heat into the timber of the joist resulting in charring of the adjoining timber and consequential joint failure.

By providing internal dowel connectors this problem is avoided, and the fire rating of the resulting joist is dependent on the web and flanges 12 and 14 of the joist. It is further noted that the round flanges 12 and 14 of the preferred embodiment of the invention are have a lesser tendency to support a flame than sawn timber as is used in traditional joists.

In use it is envisaged that the opposite end 25 of the dowel will pass through a vertical post or the like which will have a similar bonding arrangement to ensure that both ends of the dowel are properly anchored in their respective bores.

Since two dowels are provided, one for each of the flanges 12 and 14, the joist 10 will be held vertical by the two dowels, preventing twisting of the joist as load is applied to the joist in use. Additionally, by securing both flanges 12 and 14 of the joist 10 (by the dowels) potential rotation of an individual flange 12 or 14 under load is reduced. Obviously both ends of the joist will be mounted in this fashion, thereby ensuring that four high strength dowels are used to secure the joist in position. Hot dipped galvanised deformed reinforcement bars may be used, or other suitable alternatives may be considered, depending on strength requirements and environmental conditions.

Where the joist is to be connected to a vertically extending circular pole, or the like, the ends of the flanges 12 and 14 may be formed having a scalloped concave shape. The radius of curvature of this concave shape will be selected to mirror the diameter of the vertical pole to which the joist is to be connected, thereby ensuring a neat and structurally sound connection with a vertical pole of this type. It will, of course, be appreciated that the ends of the flanges 12 and 14 may be formed with a scalloped concave shape oriented so as to connect with a circular pole of any orientation. For example, a vertical radial cut (as opposed to the horizontal radial cut as depicted) could be made to form a scalloped concave shape suitable for use with a horizontally extending circular pole.

The vertical member to which the joist is connected can itself be a joist of the type described herein. In other words, joists of the type shown in FIGS. 1 to 3 can be placed at angles to each other to form, for example, a portal frame or like structure. The joist shown in FIGS. 1 to 3 can thus be used either horizontally, or vertically, or indeed in any orientation, and the term "joist" is not intended to limit in any way the application to which the structural member of the invention can be put.

To improve the strength of the end connections of the joist with vertical support to which the joist is to be connected, the web 16 may be extended beyond the end of the flanges, as depicted in FIGS. 4 to 7 of the drawings. As shown, the web 16 has a tongue 32 which extends beyond the end face of the flanges, and that tongue 32 will be slotted into a vertically extending groove 36 in the end support. The tongue 32 will be bonded with the suitable adhesive material into the vertically extending groove to thereby strengthen the integrity of the end connection and furthermore prevent twisting of the joist as load is applied to the joist in use. Since the web 16 can be made of relatively high strength material this end connection can be made to be operatively high strength, further improving the overall structural strength of the structure into which the joist is incorporated. If necessary, a laterally extending pin (not shown) can be used to laterally pin the tongue 32 to the vertical support.

It will be appreciated that the scalloped ends of the flanges act in conjunction with vertical posts to which the joists are connected to prevent the joists twisting under load. Thus, the combined effect of a shaped and nested interconnection between post and joist, and the dual dowel connection at each end of the joist will ensure that the end connection of the joist is structurally sound.

Figure 8:
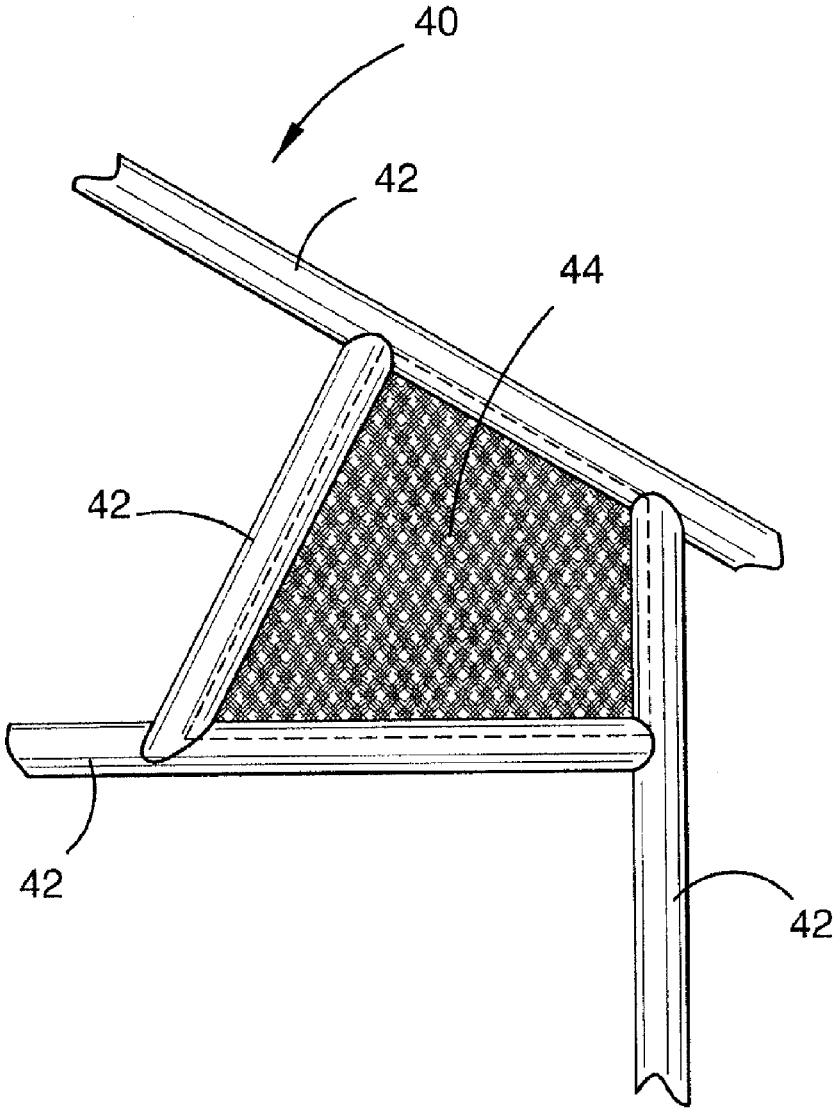
FIG. 8 shows a side view of one embodiment of a truss which incorporates the flange and web construct of the invention.

Whilst it is envisaged that a joist of the type shown in FIGS. 1 to 7 will be the preferred form of structural member with which the invention will be used, other forms of structural members are possible. FIG. 8 depicts one such additional example. The example shown comprises a connection 40 formed of a series of timber poles 42 connected together to form a truss. A web member 44 has been bonded into one of the polygon shaped gaps between the poles 42, and bonded with a slot and tongue type connection arrangement as discussed previously with respect to the flange and web arrangements of the joist shown in FIGS. 1 to 7. By bonding the web into the polygonal shaped space in this manner will ensure that the overall strength of the truss is significantly improved, particularly where a relatively high strength web material, such as plywood, is used.

As mentioned previously, the web material can be formed of any suitable material and the strength and thickness of the web will depend on the overall strength requirements of the joist, the diameters of the log, and like considerations. Clearly, if a high strength web is required, a thicker plywood material, for example, may be used. Other web materials might comprise fibrous cement or like material, or other high strength planar materials such as chipboard, particle board, and plastics type materials.

Various species of timber would be suitable to form the timber poles, particularly those type of species that tend to have a relatively constant diameter for a considerable portion of their length to minimise waste during the trimming and circularising processes referred to previously. Plantation pine materials tend to form suitable true rounds. Other materials that might be considered, for example, include coconut, Douglas fir, and various eucalypt species. In some applications, high strength bamboo poles might be considered.

The timber poles will typically be treated against insect damage and fungus and might be impregnated with various timber protection products and/or fire retardants.

As mentioned above, the joists described herein can be used in many different applications and in particular, the joists will be suitable for use as columns of a structure in which case the lower ends of the columns might either be embedded in concrete or supported on studs which in turn are embedded in concrete foundations.

It will be appreciated that the dowel type connection described herein is advantageous since it transfers connection loads directly along the central axis of the timber pole. The bore hole along the core of the timber pole serves to remove only the weakest portion of the timber pole. Also, the scalloped end of the poles serve to increase the bearing surface area of the pole ends, thereby ensuring a well supported transfer of loads between different components within the structure.

As described above, one advantage of the dowel type construction referred to herein is that all metal components are encased within timber components in the manner described herein. That arrangement not only provides an aesthetically attractive connection arrangement, but also is advantageous in that the metal components, in the event of a fire, are not directly exposed to the heat of the fire thus avoiding catastrophic collapse of the structure shortly after the outbreak of a fire.

Figure 9:
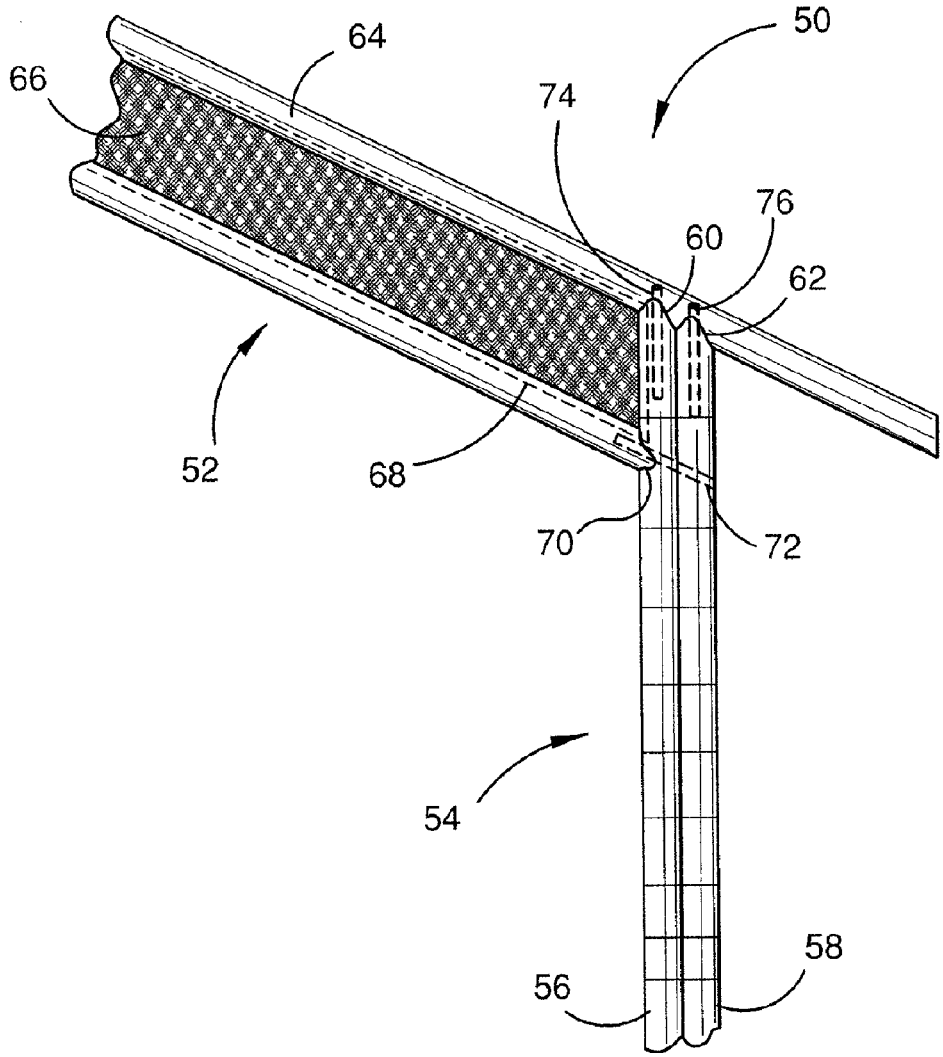
FIG. 9 shows a side view of an elbow joint including a timber joist in accordance with an embodiment of the invention.

FIG. 9 provides a view of an elbow joint 50 constructed using a joist 52 as described above and a structural member 54.

The structural member in this instance includes a pair of poles 56 and 58 joined together, each pole having a radial cut 60, 62 in its end. The joist 52 has been manufactured such that the upper flange 64 extends beyond the web 66 and lower flange 68. The radial cut 70 in the end of the lower flange 68 has been made at an angle which accommodates the angle at which the lower flange 68 abuts the pole 56 of the structural member 54. Similarly, radial cuts 60 and 62 in the poles 56 and 58 of the structural member 54 have also been made to accommodate the angle of the upper flange 64 of the joist 52.

Connection between the joist 52 and the structural member 54 is provided by a combination of: the seating of the pole 56 of the structural member 54 in the radial cut 70 of the lower joist flange 68; the seating of the upper flange 64 of the joist 52 in the radial cuts 60 and 62 of the poles 56 and 58 of the structural member 54; the insertion of the dowel 72 of the lower flange 68 of the joist 52 through the poles 56 and 58 of the structural member 54; the insertion of the dowels 74 and 76 of the poles 56 and 68 of the structural member 54 through the upper flange 64 of the joist 52.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A timber joist comprising:

a web; and first and second flanges connected together by the web, the first and second flanges each having respective facing surfaces facing each other and each having a respective slot formed therein that extends longitudinally along a length of the flange and that is dimensioned so as to receive the web therein, the web extending into and being bonded in the slots of the first and second flanges so as to be structurally integral with the flanges, and such that the web, the first flange, and the second flange form a composite structural member, wherein each of the first and second flanges comprises a timber pole having a central axis, a diameter, and opposite ends, said timber poles each being a naturally-occurring round cross-section pole having a central core and a peripheral surface trimmed so that the pole has a substantially constant cross-sectional shape over a total length thereof, wherein at least one end of one of the first and second flanges has an axial bore extending along at least part of the central axis of the flange, the axial bore being sized to receive a dowel and configured to form a load-bearing dowel connection therewith, wherein the surfaces of the first and second flanges facing one another have substantially curved profiles, wherein the web has a height greater than the diameter of the first or second flange, and wherein the web extends to a depth of at least about 20% of the diameter of the flange into which the web is embedded.

2. The timber joist according to claim 1 wherein the web extends to a depth of at least about 25%, 26%, 27%, 28%, 29% or 30% the diameter of the flange into which the web is embedded.

3. The timber joist according to claim 1 wherein the web extends substantially along a radius of the flange into which the web is embedded.

4. The timber joist according to claim 1, wherein the web is generally planar.

5. The timber joist according to claim 1, wherein the web extends the full length of the flanges.

6. The timber joist according to claim 1, wherein the web extends beyond the length of the flanges.

7. The timber joist according to claim 1, wherein the web is shorter than the length of the flanges.

8. The timber joist according to claim 1, wherein the web comprises one or more segments and the flanges include one or more slots, and wherein each web segment connects into one of the corresponding slots in the flanges.

9. The timber joist according to claim 1, wherein the web is formed of a planar material.

10. The timber joist according to claim 1, wherein the web is formed of a material selected from a group consisting of: timber, processed timber; chipboard, plywood, metal sheet, metal plate, fibre reinforced cement sheet, plastic, and fibre reinforced plastic material.

11. The timber joist according to claim 1, wherein the flanges are parallel to each other and the web is of elongate rectangular shape.

12. The timber joist according to claim 1, wherein one or more ends of the flanges is provided with a radial cut shaped and positioned to engage with a further timber pole.

13. The timber joist according to claim 1, wherein one or more of the ends of the flanges is a configured so as not to be involved in a connection, and is instead configured to be a load bearing end.

14. A structure comprising a plurality of interconnected structural members, wherein one or more of the structural members is a timber joist comprising the composite structural member according to claim 1.

15. A truss comprising:

at least two timber poles in non-parallel alignment with each other, each pole having a diameter and a slot therein, said timber poles each being a naturally-occurring round cross-section pole having a central core and a peripheral surface trimmed so that the pole has a substantially constant cross-sectional shape over a total length thereof, wherein at least one end of each of at least one of the timber poles has an axial bore extending along at least part of the central axis of the timber pole, the axial bore being sized to receive a dowel and configured to form a load-bearing dowel connection therewith, wherein the surfaces of the first and second flanges facing one another have substantially curved profiles, and a web bonded into the slots of the two timber poles to form a structurally integral assembly, wherein the web has a height greater than the diameter of the at least two timber poles, and wherein the web extends to a depth of at least about 20% of the diameter of the timber pole into which the web is embedded.

16. The truss according to claim 15 wherein the web extends to a depth of at least about 25%, 26%, 27%, 28%, 29% or 30% the diameter of the timber pole into which it the web is embedded.

* * * * *